United States Patent [19]

Lee, Jr. et al.

[11] 4,222,494

[45] Sep. 16, 1980

[54] CONTAINER

[75] Inventors: Harry W. Lee, Jr.; Joseph W. Wallace; James M. Woolard, all of Richmond, Va.

[73] Assignee: Reynolds Metals Company, Richmond, Va.

[21] Appl. No.: 774,475

[22] Filed: Mar. 4, 1977

Related U.S. Application Data

[63] Continuation-in-part of Ser. No. 709,903, Jul. 29, 1976, abandoned.

[51] Int. Cl.[2] ..... B65D 7/42

[52] U.S. Cl. ..... 220/66; 220/70

[58] Field of Search ..... 220/66, 69, 70, 3

[56] References Cited

U.S. PATENT DOCUMENTS

| | | | |
|---|---|---|---|
| D. 248,544 | 7/1978 | Saunders | D9/03 |
| 2,423,708 | 7/1947 | Keogh et al. | 113/120 H |
| 2,971,671 | 2/1961 | Shakman | 220/66 |
| 3,038,627 | 6/1962 | Daley | 220/70 |
| 3,409,167 | 11/1968 | Blanchard | 220/66 |
| 3,426,939 | 2/1969 | Young | 220/66 |
| 3,434,626 | 3/1969 | Kinslow, Jr. | 220/66 |
| 3,690,507 | 9/1972 | Gailus et al. | 220/66 |
| 3,693,828 | 9/1972 | Kneusel et al. | 220/70 X |
| 3,701,455 | 10/1972 | Warnecke | 220/66 |
| 3,730,383 | 5/1973 | Dunn et al. | 220/70 X |
| 3,760,751 | 9/1973 | Dunn et al. | 113/120 H |
| 3,789,785 | 2/1974 | Petit et al. | 113/1 G |
| 3,878,963 | 4/1975 | Knize | 220/66 |
| 3,904,069 | 9/1975 | Toukmanian | 220/66 |
| 3,905,507 | 9/1975 | Lyu | 220/66 |
| 3,942,673 | 3/1976 | Lyu et al. | 220/66 |
| 3,979,009 | 9/1976 | Walker | 220/66 |
| 3,989,159 | 11/1976 | Nixon et al. | 220/66 |
| 3,998,174 | 12/1976 | Saunders | 113/120 H |
| 4,048,934 | 9/1977 | Wallace | 220/66 X |

FOREIGN PATENT DOCUMENTS

| | | | |
|---|---|---|---|
| 166602 | 3/1973 | Canada . | |
| 969114 | 6/1975 | Canada | 190/78 |

*Primary Examiner*—Steven M. Pollard

*Attorney, Agent, or Firm*—Glenn, Lyne, Girard, Clark & McDonald

[57] ABSTRACT

The side wall of a container is joined to the bottom portion thereof by a first frustoconical portion and a first semi-torroidal portion which, in turn, is joined to a second semi-torroidal portion; and, a bottom closing portion. In one embodiment the second semi-torroidal portion is joined to the bottom closing portion by a second frustoconical portion; a third semi-torroidal portion; and, a third frustoconical portion. In another embodiment the bottom closing portion is substantially flat but adapted to be domed outwardly under pressure and "cricket" inwardly when pressure is relieved.

47 Claims, 13 Drawing Figures

FIG. 3
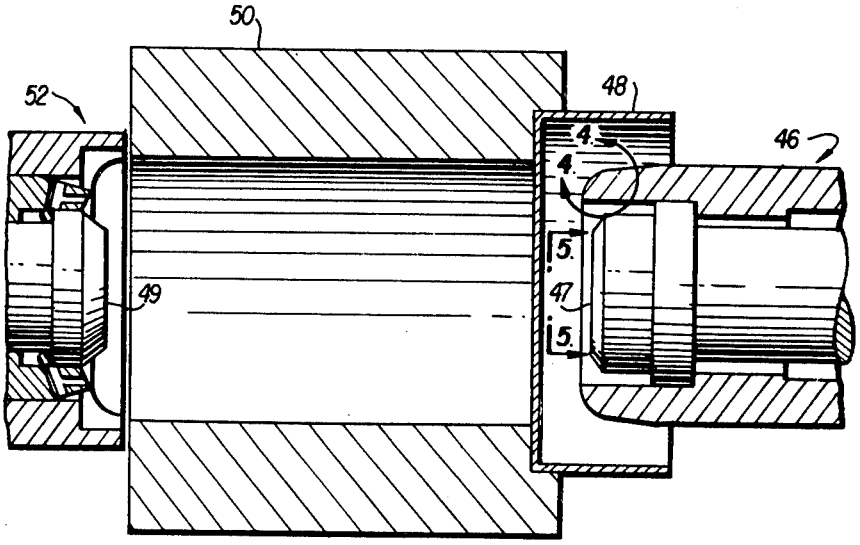
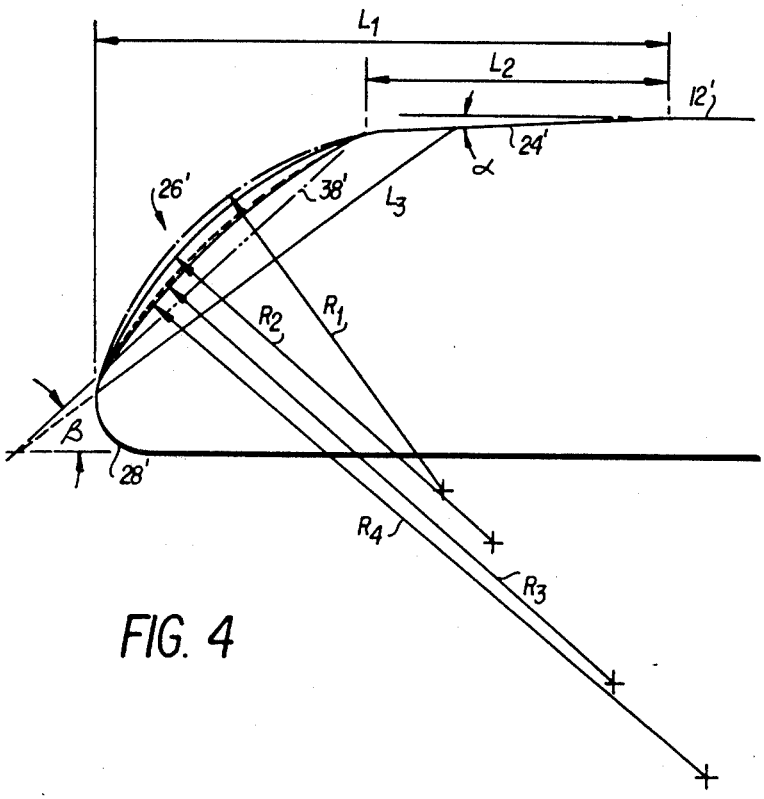
FIG. 4

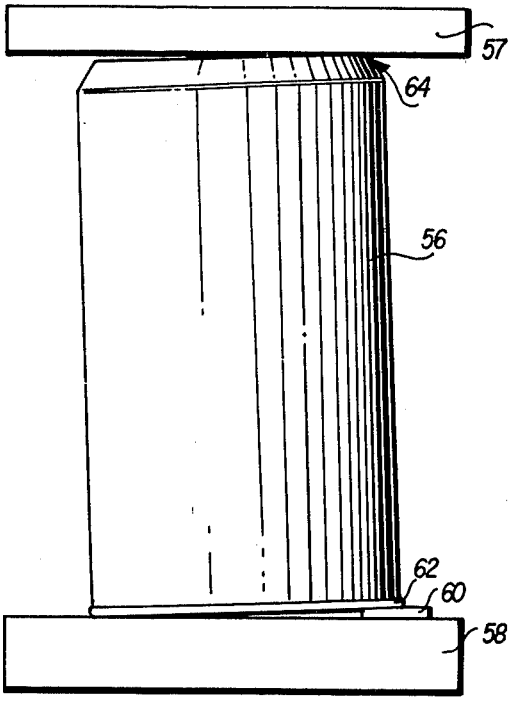
FIG. 6
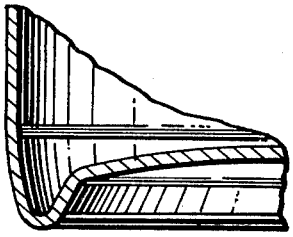
FIG. 7A
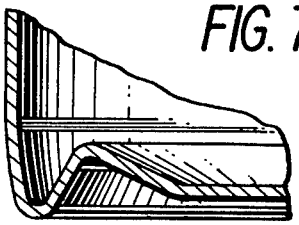
FIG. 7B
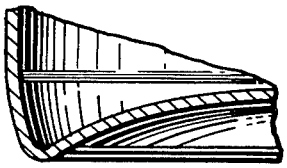
FIG. 7C
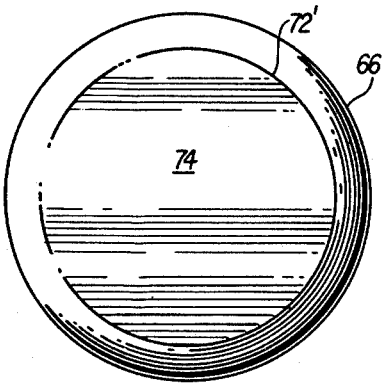
FIG. 10
FIG. 8
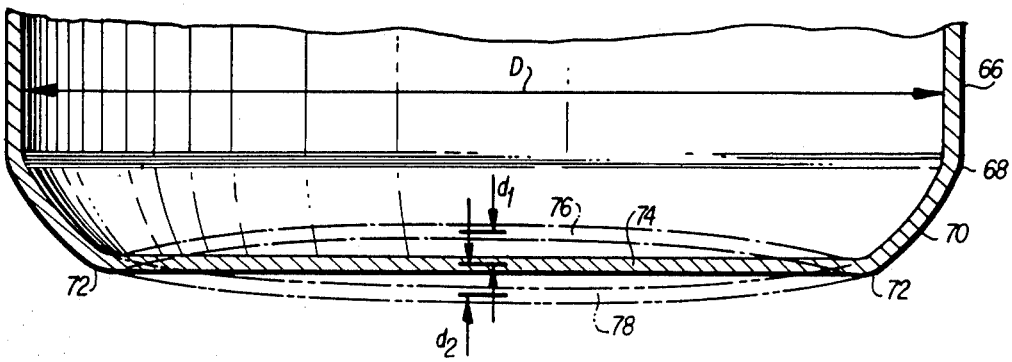

CONTAINER

BACKGROUND OF THE INVENTION

This is a continuation-in-part of U.S. patent application 709,903 filed on July 29, 1976 now abandoned which, in turn, relates to an improvement of the container construction described in U.S. patent application Ser. No. 656,045 filed on Feb. 6, 1976 and assigned to the same assignee as the instant case. In this respect, Ser. No. 656,045 is incorporated herein by reference.

Containers of the type described in Ser. No. 656,045 exhibited certain unexpected and outstanding strength characteristics when compared with similar characteristics of certain prior art types of cans. When the Ser. No. 656,045-types of cans were produced at top production-speeds, however, they sometimes had a tendency to increase the normally expected wear on the punches with which the cans were made. Illustrated embodiments of the instant invention, however, provide a container wherein such punch-wear is reduced.

Containers of the "drawn-and-ironed" type exhibit three main points of failure when subjected to compressive loads such as occur when the cans are filled and closed with a conventional end. Such failures tend to occur in either the can's neck portion or its sidewall or in the can's bottom. The instant invention provides a container wherein such failures occur most frequently in the container's bottom portion; and, moreover, can absorb relatively large quantities of energy before catastrophically failing in the sense that the container is no longer suited for its intended purpose. Moreover, as will be explained more fully shortly, cans of the invention are quite predictable in that failures can be expected to occur within a relatively narrow range of loads. Hence, they can be made from thinner stocks since smaller margins of error are permitted.

There are several advantages to providing a container that is most likely to fail at the bottom. In this regard, particularly in "drawn-and-ironed" containers, the thickness of the bottom does not differ significantly from the sheet stock with which such cans are normally constructed. Hence, the bottom-thickness of such cans can be relatively accurately controlled. It is the sidewall portions of these cans that are "drawn-and-ironed," however, and the side wall thicknesses, therefore, are more difficult to control. Consequently, to the extent a can's failure modes are primarily at the bottom, the can's strength can be more accurately controlled and its failures more accurately anticipated.

Additionally, the can of the instant invention is structured so that compressive forces cause initial deflection (a type of failure) in the bottom of the container; and, moreover, the bottom undergoes relatively large distortions before the can undergoes catastrophic failures such as in its side wall or neck. Consequently, so long as the compressive forces are not so large as to cause catastrophic failure, the container can still be filled and seamed without being discarded. In this connection, the can of the invention absorbs substantial quantities of energy as the bottom deflects. Consequently, it is possible to save more cans for filling and seaming than might otherwise be the case.

A still further advantage of the invention lies in the resulting can's ability to be constructed from a thinner gauge sheet stock. Similarly, as will become more apparent shortly, although more absorptive of energy, the can of the invention has a somewhat larger volume than that described in Ser. No. 656,045 and, to that extent, one embodiment of the invention has an even greater ability to have the position of its central portion selectively adjusted in order to maintain can-volume and accommodate relatively large amounts of tool-wear without requiring new tooling.

A further advantage of another embodiment of the invention is its tendency to have a center portion of its bottom "cricket" inwardly upon relief of pressure when the can is opened after filling. In this manner the particular embodiment is rendered more physically stable after it is opened even though its bottom has a tendency to "dome" outwardly when pressurized.

SUMMARY

A container of the invention includes a side wall that is joined to a bottom portion thereof by a first frustoconical portion and a first semi-torroidal portion. The first semi-torroidal portion is, in turn, joined to a second semi-torroidal portion and, a bottom-closing portion. This structure results in a container which has high energy absorption capabilities and whose failure-mode is predominantly in the bottom portion thereof.

BRIEF DESCRIPTION OF THE DRAWINGS

The foregoing and other features and advantages of this invention will be apparent from the more particular description of preferred embodiments thereof as illustrated in the accompanying drawings wherein the same reference numerals refer to the same elements throughout the various views. The drawings are not necessarily intended to be to scale, but rather are presented so as to illustrate principles of the invention in clear form.

In the drawings:

FIG. 3 is a schematic illustration of a drawing and ironing machine;

FIG. 4 is a greatly enlarged fragmentary view of a portion of a punch taken along the arc 4—4 in FIG. 3.

FIG. 6 is a schematic illustration of a test fixture used to test OFF-AXIS strength of various types of cans;

FIG. *7a, b,* and *c* are schematic illustrations of cans tested in the structure of FIG. 6;

FIG. 8 is a fragmentary cross-sectional illustration of the bottom portion of another embodiment of the invention;

FIGS. *9a* and *b* are schematic illustrations of a bottom forming machine for the FIG. 8 embodiment; and, FIG. 10 is a view of a can bottom taken along the lines 10—10 in FIG. *9b*.

DETAILED DESCRIPTION

Figure 1:
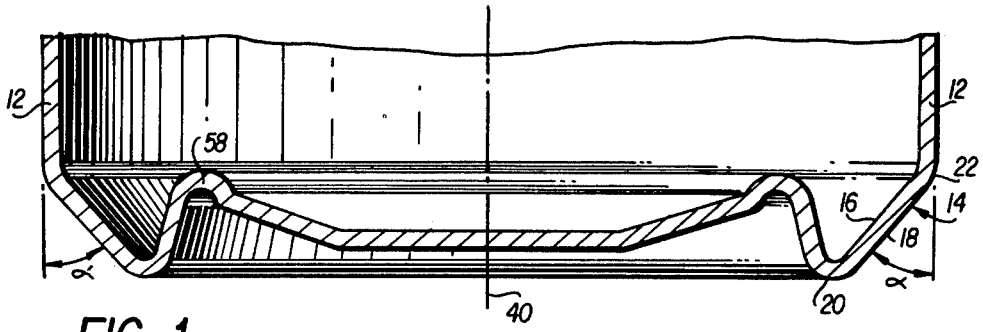
FIG. 1 PRIOR ART
FIG. 1 is a fragmentary cross sectional schematic illustration of a prior-art type of can.

FIG. 1 illustrates a prior art type of container wherein a cylindrical side wall 12 is joined at an angle $\alpha$ to a first frustoconical portion 14 having substantially flat inner and outer surfaces 16 and 18. In this regard, portion 14 extends between an outwardly convex annular bottom bead 20 and a transition point 22 between the side wall 12 and the first frustoconical portion 14.

Figure 2:
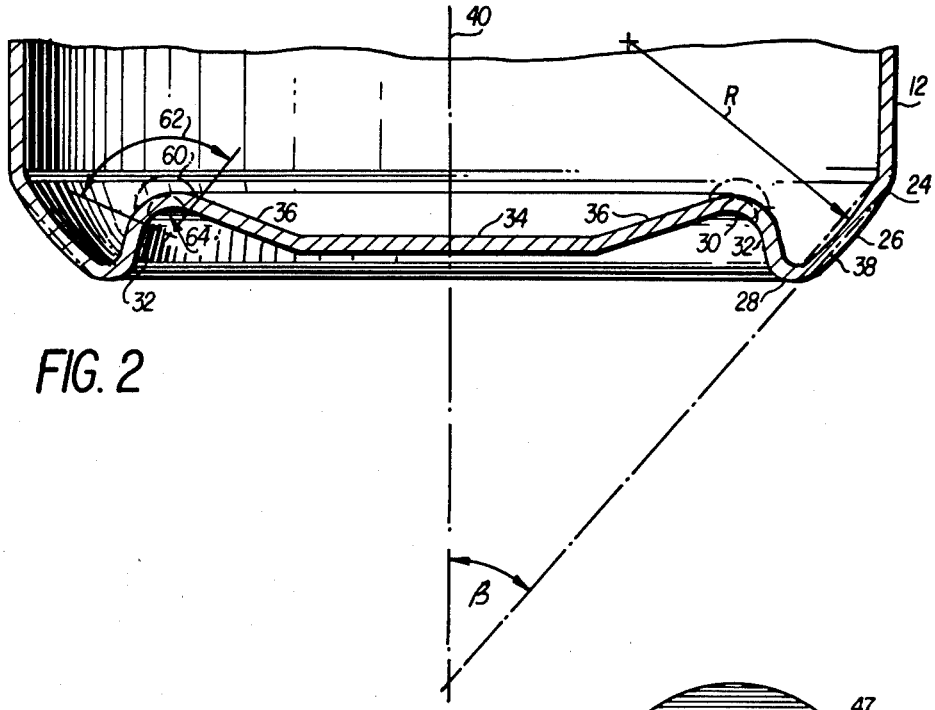
FIG. 2 is a fragmentary cross sectional illustration of the bottom portion of an embodiment of the invention.

FIG. 2 illustrates the bottom portion of an embodiment of a container of the invention. Therein, the side wall 12 is joined to a first frustoconical portion 24 which, in turn, is joined to a first semi-torroidal portion 26 which, in turn, is faired into a second semi-torroidal portion 28. The second semi-torroidal portion 28 is attached to a third semi-torroidal portion 30 by a second frustoconical section 32—the other side of the third semi-torroidal portion 30 being joined to a flat central portion 34 by a third frustoconical portion 36.

The first semi-torroidal portion 26 is outwardly convex from a cord 38 extending between the first frustoconical portion 24 and the second semi-torroidal portion 28—the chord 38 making an angle $\beta$ with the container's axis 40. In this respect, in connection with preferred embodiments of the invention, the radius R of the first semi-torroidal portion 26 and the angle $\beta$ were varied between certain limits as will now be discussed in connection with a punch that is used to form the structure of FIG. 2.

The schematic illustration of FIG. 3 represents a punch 46 about to drive a "cup" 48 through a draw-and-ironing structure 50 and against a bottom former 52. Except as will now be described, the FIG. 3 elements are conventional and will not be described further. The draw-and-ironing structure 50, for example, includes conventional redrawing dies, ironing rings, pilot rings, and the like, but those elements form no part of the instant invention.

FIG. 4 represents a portion of the punch 46 which forms the first semi-torroidal section 26 of the can-bottom illustrated in FIG. 2. In this regard, portions of the punch in FIG. 4 which correspond to the can-bottom of FIG. 2 have their correspondance indicated by prime signs added to similar reference numerals. For example, the can's side wall 12 corresponds to side wall 12′ of the punch; the can's first frustoconical portion 24 corresponds to frustoconical punch portion 24′; the can's first semi-torroidal section 26 corresponds to first semi-torroidal punch portion 26′; and, the can's arcuate second semi-torroidal portion 28 corresponds to punch portion 28′.

The frusto conical portion 24′ is at an angle gamma to the side wall 12′ . In this regard, best results can be expected when $\gamma$ is within the range of 1° to 6°. Similarly, best results can be expected when L2, the axial length of the first frustoconical portion 24′, is between 0.150 inches and 0.600 inches for a pressurized container of the conventional "beer can" type. In these respects, the numeric ratio Q1 of gamma (in degrees)/$L_2$(in inches) should be between about 1 and 60, but is more preferably about 12. If Q1 becomes too small, excessive tool wear is likely; and if $Q_1$ becomes too large the containers' energy absorbtive capabilities are diminished.

The first semi-torroidal portion 26′ is arcuate about cord 38′ which, when extended, makes an angle $\beta$ with the container's axis. When $\beta$ is increased, the dimension $L_2$ also increases if other parameters remain fixed. Similarly, if $\beta$ decreases (other parameters remaining constant) the dimension $L_2$ becomes smaller, as the cord increases in length. This is indicated by the dimension $L_3$ which represents the cord 38′ in any of its various positions depending upon the changes of the angles $\beta$ and $\gamma$.

In the above regard, the radius of the first semi-torroidal portion 26′ should be between 0.200″ and 0.700″ for a pressurized container of the conventional beer can type. Generally, speaking, however, the numeric ratio $Q_2$ of $\beta$ (in degrees)/R (in inches) should be between about 35 and 300. Containers having $Q_2$ ratios of less than about 35 appear to have body and neck failures sooner than bottom failures; and, containers having $Q_2$ ratios over 300 appear to have relatively low initial deformation points. The most preferred $Q_2$ ratio is about 85 which is in the lower end of the above range of $Q_2$ ratios rather than in the middle as might otherwise be expected.

The ratios of L1/R1 ($Q_3$) and L1/L2 ($Q_4$) appear to be of somewhat less significance. A preferred range for $Q_3$, however, is between about 0.5 and 2.5 with excellent results being obtained where $Q_3$ is about 0.965. Similarly, a preferred range for $Q_4$ is between about 1.35 and 3.25 with excellent results being obtained when $Q_4$ is about 1.93.

Containers of the type just described were subjected to testing to determine their energy absorptive abilities and their tendencies to undergo bottom deformation prior to failure of their sidewalls and necks. Test results of preferred containers were then compared with containers having bottom configurations corresponding to that of FIG. 1. Based on those test results, it was determined that cans of the above-described type having first semi-torroidal sections such as 26′ had substantially higher energy absorption capabilities when compared with the prior art "control" cans. In one preferred embodiment, for example, where $Q_1$ was 12, $Q_2$ was 84; $Q_3$ was 0.965; and $Q_4$ was 1.93; the container's energy absorption capabilities were 537 percent higher than the average energy absorption capabilities of the control cans which, themselves, have outstanding strength characteristics when compared with similar characteristics of certain prior art types of cans. One of the tested cans of the invention had even higher energy absorption capabilities, but its $Q_2$ ratio was at the low end of the preferred range and was not as reliable about undergoing adequate bottom deformation prior to sidewall failure. Hence, although it is possible to vary the above parameters to obtain increased energy absorption capabilities, this is done at the expense of failure-mode predictability which will now be discussed.

As indicated above, it has usually been difficult to determine the type of container-defect or press-defect that has led to container failures. Primarily this was because failure modes were quite random. By structuring the containers in accordance with the instant invention, however, it has been found that most (roughly 95 percent) of the containers will collapse in their bottom portions before they will fail in either the neck or the sidewall. Additionally, it has been found that this factor can be used to trouble-shoot the presses if the cans are periodically tested as they are fabricated. In this regard, as cans are pressed, certain ones are randomly selected and subjected to a compression test to determine the can's failure mode. As a series of cans from a given press are thusly tested, a higher than normal percentage of neck failures is used to indicate, for example, that the necks are too thin and/or the press's necking dies are worn.

Similarly, if a significant percentage of the cans exhibit body failures it is used to indicate, for example, that the container's walls are too thin, indicating an abnormality in the profile of the punch.

In the same light, if the container's bottom collapses at an unacceptably low compressive force, this provides an indication, for example, of a defect in the nose of the punch. Where containers of the FIG. 1-type are compression-tested, however, the failure modes are so unpredictable that the above described testing and trouble-shooting method is not practical.

As noted above, particularly in connection with machine trouble-shooting, it is desirable to be able to identify the press which constructed a given can. A problem in the past, however, has been that embossed or punched markings on the containers have led to stress concentrations which produced premature can failure. But, in the instant case it has been found that bottoms of cans can be "air" or "lubrication" embossed without appearing to cause detrimental stress concentrations.

Figure 5:
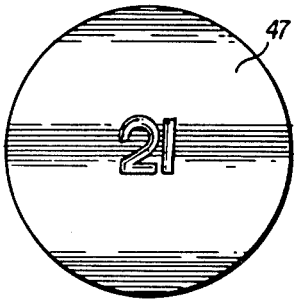
FIG. 5 is a view of a portion of a punch face taken along the lines 5—5 in FIG. 3.

In the above regard, FIG. 5 illustrates the bottom-forming end 47 of the punch 46 in FIG. 3 wherein the number "2" is etched therein while the corresponding "die" portion 40 of the bottom former 52 remains blank. Nevertheless, when a can bottom is rammed between the marked and unmarked press elements, it is acceptably marked by the air or lubricant that is trapped between the two press elements.

Similarly, suitable press identifying indicia can be engraved or embossed on the bottom-former die element 49 and the corresponding punch-fore 47 left blank. In both cases the can-bottom is suitably air or lubrication embossed without appearing to cause detrimental stress concentrations.

The above-described structure provides containers which not only have high energy absorption capabilities, but have their failure modes concentrated mostly in the container's bottom portions. In this manner, it is less difficult to control can quality; easier to determine the causes of can defects; and, because of the increased energy absorbing capabilities, possible to make such containers from relatively thin stock. In this respect, a standard beer can has a side wall thickness of about 0.0051 inch and a bottom thickness of about 0.0145 inch. As will now be discussed, however, cans having Frustoconical Sections 24 and first semi-torroidal sections 26 have satisfactorily been used under commercial beer can filling conditions even though their average side wall thicknesses were 0.0045 inch and their bottom thicknesses were 0.041 inch.

Prior to discussing the above-described commercial conditions, it should be noted that the sidewalls of beer cans can only be controlled to about 0.002 inch average-wall-thickness; and actual-wall-thickness may vary about 0.008 inch from one point on a given can wall to another. A standard can having an average wall thickness of 0.0051 inch, for example, might have a wall thickness of 0.0047 on one side of a can and 0.0055 on another side of the can. Moreover, as a can punch such as 46 (FIG.3) heats up and expands, it produces cans having walls that become progressively thinner because the corresponding ironing dies do not expand as rapidly as the punch.

In any event, 6 skids of "thin" cans (about 47,880 cans) in accordance with the invention had bottoms of standard thickness and were run under commercial brewery conditions. In this respect, the punches in the ironing dies for all of the test cans were dimensioned to produce "thin" sidewalls so that the test cans had a nominal average wall thickness of 0.0045 inch. Every effort was made to run the "thin" cans under commercial conditions where they were also filled and capped under commercial conditions to be sure that the commercial equipment would accept and process such cans in a normal sequence.

The results of the above-described commercial-conditions test indicated that the variously dimensioned "thin" cans operated fully acceptably under the commercial test conditions. That is, their catastrophic failure rate was no greater than the normal failure rate for standard cans. In this regard, normal thickness cans operating under the same conditions were expected, when randomly tested, to withstand a normal column load of 400 pounds. Because of the ability of cans of the invention to absorb more energy before catastrophic failure, however, the acceptable column load for randomly tested "thin" cans of the invention was able to be reduced to 360 pounds; yet, as noted above, the "thin" cans nevertheless performed satisfactorily under commercial filling conditions.

Standard wall and bottom thickness cans of the invention are also tested to determine their failure predictability for "off-axis" loads. In this respect, cans are more often subject to "off-axis" crushing forces than "on-axis" crushing forces such as occur during the filling process. When such cans are used in automatic vending machine environments or the like, for example, filled; pressurized cans are dropped from a height in such a manner that crush-producing forces thereon are most often of the "off-axis" type. Consequently, off-center loading tests such as will now be described, identify inherent strengths and weaknesses of can designs.

The "off axis" tests were conducted by placing test cans such as 54 (FIG. 6) between cross heads 57 and 58 of a compression tester such as a "TTB" Floor Model "Instron" compression tester having a type "FR" load cell. Various thicknesses of shim stock 60 were then placed under one edge of a test fixture 62 to tilt the can "off-axis" so that the force of cross head 57 was localized on the bottom of each tested can (such as at 64 on can 56 in FIG. 6) to provide an "off-axis" force rather than a Force distributed uniformly across the bottom of the can so as to produce a uniform axial load.

The tester's cross head 57 was moved at a rate of 0.5 inch per minute; an accompanying strip chart speed was set at 5 inches per minute; and the parameters of the compression tester were such that each can test produced a graph of column-load v. deflection.

Different "angles of tip" were obtained by placing the cans at different angles with the horizontal (including 0) by the placement of various thicknesses of shim-stock under the test fixture as noted above. All cans tested were unwashed, but were "necked and flanged" to obtain uniform placement on fixture 62. The average sidewall and flange thickness of each can-type was recorded; and, all of the cans of a given bottom-design were from a single draw-and-iron press in order to reduce the possibilities of their being significant differences between cans of a given type; and, all of the cans were tested on the same compression tester.

Off-axis test results of cans having bottoms configured in accordance with FIG. 2 compared favorably with otherwise similar cans having bottoms configured in accordance with FIG. 1. That is, all of the FIG. 2 configured cans withstood axial loads of greater than 400 pounds for all angles of tip resulting from shim thicknesses of zero to 0.050 inch while, at the same time, in over 96 percent of the cans tested, "failures" were restricted to the can bottoms (as opposed to catastrophic body failures) which, as noted above, usually result in a can that is nevertheless usable.

The same tests were run on cans having bottoms configured in accordance with FIGS. 7*a*, *b*, and *c* and the results were then compared with otherwise similar cans having their bottoms configured in accordance with FIG. 2. These comparisons were dramatic. That is, at 0 shim thickness cans of all four bottom configurations withstood a 400 pound load without catastrophic failure at the maximum shim thickness of 0.050 inch, however, only the FIG. 2 configured can withstood a 400 pound load. In fact, the FIG. 2 configured can showed only a minor decrease in maximum load between zero shim thickness (440 lbs.) and 0.050 inch shim thickness-420 lbs.) and, as noted above, the actual failure modes were concentrated primarily in the can bottoms.

At as little as 0.015 inch shim thickness, neither the FIG. 7*a* nor the FIG. 7*c* configured bottoms would withstand a 400 pound average load. That is, at that shim thickness the FIG. 7*a* configured can failed at an average of 325 pounds and the FIG. 7*c* can failed at an average of 395 pounds. Moreover, at only 0.020 inch shim thickness, the FIG. 7*b* configured can also failed to withstand an average load of 400 pounds--failing at 305 pounds of average off-axis load. Consequently, the can of the invention not only provides a more predictable failure mode, but its overall off-axis strength is considerably in excess of the FIG. 7 configurations which represent other standard types of can bottoms.

Additionally, it should be noted that the FIG. 2 bottom-structure does not include a strengthening bead such as 58 in FIG. 1. If it is desired to further increase the strength of the FIG. 2 can, therefore, this can be accomplished by adding a strengthening bead such as 60 shown in phantom in FIG. 2. This third semi-torroidal bead 60 is of substantial arcuate length and, in effect, is substituted for the third semi-torroidal portion 30 located between the second and third frustoconical portions 32 and 36. When viewed in cross section, for example, the bead 60 subtends an arc 62 of greater than 100° and preferably on the order of 180°.

The third semi-torroidal bead 60 has a radius 64 which, for a typical beer-type container, may range between 0.030 and 0.187", but is preferably about 0.060". In this regard, the use of beads such as 60 has resulted in cans being able to have their pressures increased by as much as 5 psi; or if preferred, the stock thickness can be correspondingly reduced in addition to the reductions discussed above.

It is believed that the frustoconical portions 24 and the first semi-torroidal portion 26 in FIG. 2 contribute significantly to the energy absorptive abilities of the above-described cans. In this respect, relatively "flat-bottom" cans having similar first semi-torroidal portions have also exhibited outstanding energy absorptive qualities. In FIG. 8, for example, sidewalls 66 of a can are joined to a first frustoconical portion 68 which, in turn, is joined to a first semi-torroidal portion 70. These portions of the FIG. 8 structure are substantially identical to the corresponding portions of the FIG. 2 can. Hence, they will not be further described. Instead of the first semi-torroidal portion 70 being faired into a frustoconical section such as 32 in FIG. 2, however, the first semi-torroidal portion 70 is faired at second semi-torroidal portion 72 into a relatively flat bottom-closing portion 74. In this respect, it is preferred that the bottom-closing portion 74 be domed inwardly slightly when the can is unpressurized as illustrated by phantom line 76.

The distance d, between the illustrated "flat" bottom closing portion 74 and phantom line 76 should be at least about 0.005 inch and no more than $d_2$ between the "flat" bottom closing portion 74 and phantom line 78 to be described shortly. That is, for a standard beer can (2.6 inch D) containing about two and one-half volumes of $CO_2$, the distance $d_1$ should be no more than about 0.050 inch, but can be somewhat more if packaged-can stability is not too significant; and, moreover, this value decreases as can diameter D decreases. For "mini-cans" (1.3 inch D), for example, $d_1$ should be no more than about 0.40 inch; and, for larger can diameters (over 3.0 inch D) $d_1$ can increase to 0.70 inch and even this can decrease somewhat as can height increases. For all cans, however, the ratio of D to $d_1$ should be between about 40 and 500.

In a manner to be described shortly, upon fabrication, the bottom closing portion 74 of the FIG. 8 can is inwardly domed to phantom line 76, but when the can is subsequently pressurized, the bottom closing portion 74 domes outwardly to phantom-line 78. Then, when the can is opened and its pressure relieved, the bottom closing portion 74 "crickets" inwardly to again assume the position illustrated by phantom-line 76. This results in a can that is somewhat unstable during shipment and storage of filled cans, but which is quite stable once the can is opened and the contents being used.

An additional advantage of having the bottom closing portion 74 domed inwardly slightly is that it makes the can more easily supportable by vacuum-holding means used during fabrication and filling. That is, it is frequently convenient to hold or transport unfilled cans by applying a vacuum to the bottom thereof through a vacuum port on a suitable fixture. If the can bottom remains flat against a vacuum-port however, the vacuum is only applied to that portion of the can's bottom corresponding to the size of the vacuum port. Consequently, it is desirable for the can's bottom to be somewhat removed from the surface of the fixture so that the port's vacuum is applied over a substantial area of the can's bottom.

When cans of the FIG. 8 configuration were tested for pressure integrity, they were pressurized to 150 pounds per square inch without any noticeable permanent deformation of their bottoms. This is significant because specifications for otherwise-corresponding conventional cans call for only 90 psi prior to the time a bottom buckles. In addition, the FIG. 8 cans withstand wall loadings to substantially the same extent as described above in connection with the FIG. 2 can configurations. Additionally, when the FIG. 8 cans were pressurized, they domed outwardly to a position corresponding to phantom line 78 in FIG. 5, but "cricketed" inwardly to a line corresponding to 76 in FIG. 5 as soon as internal pressure was relieved.

The abovedescribed "cricketing" phenomenon is brought about by a coining step during formation of the can's bottom. That is, the bottom of each can is coined along a circular line in the faired second semi-torroidal portion 72 as illustrated in FIG. 10 and as will now be described in connection with FIG. 9.

Figure 9B:
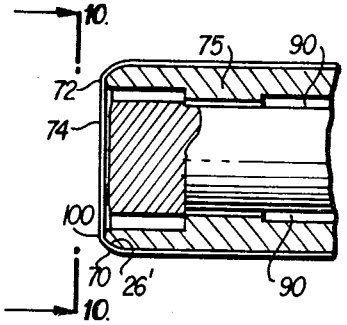
Figure 9A:
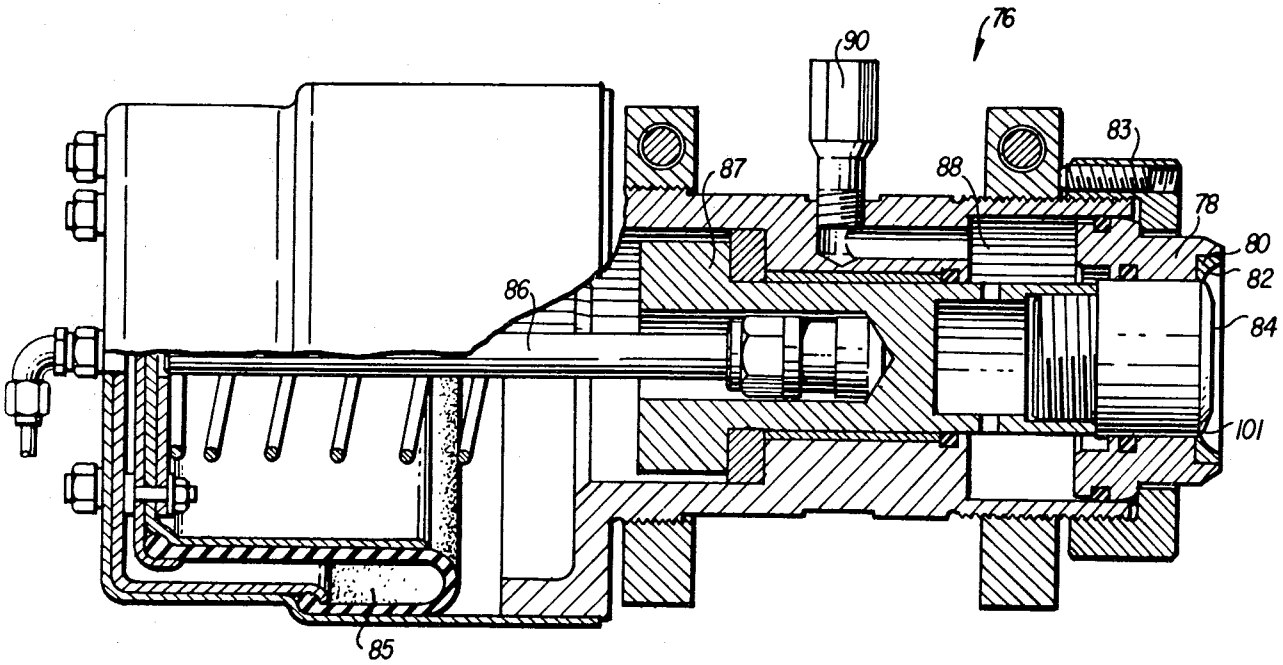

The schematic illustrations of FIGS. 9*a* and 9*b* represent a punch 75 (similar to punch 46 in FIG. 3) about to drive a can against a bottom former 76. For purposes of simplicity, a draw-and-ironing structure (such as 50 in FIG. 3) is not illustrated in FIG. 9, but the bottom former 76 includes an outer ring 78 having an insert 80 therein with semi-torroidal surface 82 corresponding to surface 26' in FIGS. 4 and 9*b*.

The outer ring 78 is contained within a stationary member 83 of the bottom former which has a bottom pad 84 somewhat slidably disposed within both the outer ring 78 and the stationary member 83. That is, an air diaphragm 85 such as that which might be used on an air brake, places 80 pounds per square inch pressure on 50 square inches of surface to apply 4,000 pounds of force in the direction of arrow 86 to a shaft structure 87 connected to the bottom pad 84. Consequently, bottom pad 84 is slidable to the left in FIG. 9*a* against the 4000 pound force acting on shaft structure 87.

A chamber 88 within the bottom former 76 is located behind the outer ring 78 to surround the bottom pad member 84 as shown; and, air pressure at 90 pounds per square inch is delivered through port 90 to the chamber 88.

As the punch 75 is moved to the left in FIG. 9 air pressure at 90 psi is also delivered through the punch by ports 89 to act against the inside of the bottom 74 of the can.

As the punch continues to move to the left, the can bottom strikes surface 82 on insert 80 along a circle to contact identified as 72' in FIG. 10. This holds the metal on the radius 26 tightly against the punch 75.

The bottom 74 of the can next strikes the surface of bottom pad 84 which starts to dome the bottom 74 inwardly. A smaller nose radius 100 of the punch 75 pinches the metal between the radius 100 and the surface of bottom pad 84 at point 101; and, this action coins the metal. This is, the metal is squeezed so that its thickness is changed somewhat at the point of contact. This sets the bottom slightly inwardly, which causes the cricketing phenomenon described above.

Any further forward movement of the punch 75 merely moves the bottom pad 84, the shaft structure 87 and the outer ring 78 to the left against the 4000# force of the diaphragm.

At that time, however, the first semi-torroidal section 70 (corresponding to 26' on the punch) has been formed between the punch and the outer ring 80; the can's bottom has been domed in to the desired extent; and, a coined ring 72' has been formed around the can's bottom by virtue of the initial line contact of the can's bottom at the circle 72' between the punch 75 and the surface 101 of the bottom pad 84.

While the invention has been particularly shown and described with reference to preferred embodiments thereof, it will be understood by those skilled in the art that various changes in form and details may be made therein without departing from the spirit and scope of the invention. For example, the flat bottom portion 34 can be selectively adjusted downwardly as described in Ser. No. 656,045 to increase the container's volume as it otherwise tends to decrease due to wear of the punch 46. It should be noted in this respect that this volume adjustment is made without any alteration in the container's overall top-bottom dimension. Hence, a single punch can be used to produce far more cans than would otherwise be the case, but the thusly produced cans nevertheless continue to meet the relatively exacting dimensional requirements for cans that are used in automatic dispensing machines.

The embodiments of the invention in which an exclusive property or privilege is claimed are defined as follows:

1. A container having a cylindrical side wall and a bottom wall closing one end thereof and comprising:

a frustoconical portion having one end thereof directly attached to said side wall;

a first semi-torroidal portion having one end thereof directly attached to the other end of said frustoconical portion;

a second semi-torroidal portion having one end thereof directly attached to the other end of said first semi-torroidal portion; and a central bottom-closing portion directly attached to the other end of said second semi-torroidal portion.

2. The container of claim 1 wherein said second semi-torroidal portion is coined.

3. The container of claim 2 wherein said bottom-closing portion domes inwardly when said container is unpressurized, but domes outwardly when said container is pressurized.

4. The container of claim 3 wherein said bottom-closing portion domes inwardly between 0.005 inch and 0.050 inch.

5. The container of claim 3 wherein the ratio of the diameter of said side wall of said container to the distance which said bottom-closing portion domes inwardly when said container is unpressurized is between 40 and 500.

6. The container of claim 1 wherein said bottom-closing portion is domed inwardly when said container is unpressurized, but domes outwardly when said container is pressurized.

7. The container of claim 6 wherein said bottom-closing portion domes inwardly between 0.005 inch and 0.050 inch.

8. The container of claim 6 wherein the ratio of the diameter of said side wall of said container to the distance which said bottom-closing portion domes inwardly when said container is unpressurized is between 40 and 500.

9. The container of claim 1 wherein said frustoconical portion is located at an angle $\gamma$ with respect to said side wall and wherein said angle $\gamma$ is between 1° and 6°.

10. The container of claim 9 wherein said angle $\gamma$ is 3°.

11. The container of claim 1 wherein a cord extending between the junctions of said first semi-torroidal portion with said frustoconical portion and said second semi-torroidal portion, respectively, makes an angle $\beta$ with the axis of said cylindrical side wall and wherein said angle $\beta$ is between 33° and 47°.

12. The container of claim 11 wherein said angle $\beta$ is between 37° and 43°.

13. The container of claim 1 wherein the axial distance between the junctions of said frustoconical portion with said side wall and said first semi-torroidal portion, respectively, is between 0.150 inch and 0.600 inch.

14. The container of claim 13 wherein said axial distance is 0.250 inch.

15. The container of claim 1 wherein said frustoconical portion is located at an angle $\gamma$ with respect to said side wall and wherein said angle $\gamma$ (in degrees) bears a numeric ratio $Q_1$ to the axial distance between the junctions of said frustoconical portion with said side wall and said first semi-torroidal portion, respectively, of between 1 and 60.

16. The container of claim 15 wherein $Q_1$ is 12.

17. The container of claim 1 wherein the radius of said first semi-torroidal portion is between 0.200 inch and 0.700 inch.

18. The container of claim 17 wherein said second semi-torroidal portion is coined.

19. The container of claim 17 wherein said bottom-closing portion is domed inwardly when said container is unpressurized, but domes outwardly when said container is pressurized.

20. The container of claim 17 wherein said bottom-closing portion domes inwardly between 0.005 inch and 0.050 inch.

21. The container of claim 17 wherein the ratio of the diameter of said side wall of said container to the distance which said bottom-closing portion domes inwardly when said container is unpressurized is between 40 and 500.

22. The container of claim 1 wherein a cord extending between the junctions of said first semi-torroidal portion with said frustoconical portion and said second semi-torroidal portion, respectively, makes an angle $\beta$ with the axis of said cylindrical side wall; and wherein said angle $\beta$ (in degrees) is in a numeric ratio $Q_2$ with the radius of said first semi-torroidal portion (in inches) of between about 35 and 300.

23. The container of claim 22 wherein $Q_2$ is 85.

24. The container of claim 22 wherein said frustoconical portion is located at an angle $\gamma$ with respect to said side wall and wherein said angle $\gamma$ (in degrees) bears a numeric ratio $Q_1$ to the axial distance between the junctions of said frustoconical portion with said side wall and said first semi-torroidal portion, respectively, of between 1 and 60.

25. The container of claim 24 wherein $Q_1$ is 12 and $Q_2$ is 85.

26. The container of claim 1 wherein the distance ($L_2$) between the junction of said frustoconical portion with said side wall and the junction of said first semi-torroidal portion with said second semi-torroidal portion is in a numeric ratio ($Q_3$) with the radius (R) of said first semi-torroidal portion of between 0.5 and 2.5.

27. The container of claim 26 wherein $Q_3$ is 0.965.

28. The container of claim 1 wherein the axial distance ($L_1$) between the junction of said frustoconical portion with said side wall and the junction of said first semi-torroidal portion with said second semi-torroidal portion is in the numeric ratio ($Q_4$) with the axial distance ($L_2$) between the junctions of said frustoconical portion with said side wall and said first semi-torroidal portion of between 1.35 and 3.25.

29. The container of claim 28 wherein $Q_4$ is 1.93.

30. The container of claim 1 wherein:

$L_1$ is the axial distance between the junction of said frustoconical portion with said side wall and the junction of said first semi-torroidal portion with said second semi-torroidal portion;

$L_2$ is the axial distance between the junctions of said frustoconical portion with said side wall and said first semi-torroidal portion, respectively;

R is the radius of said first semi-torroidal portion;

$\gamma$ is the angle between said frustoconical portion and said side wall;

$\beta$ is the angle between the axis of said cylindrical side wall and a cord extending between the junctions of said first semi-torroidal portion with said frustoconical portion and said second semi-torroidal portion, respectively;

$Q_1$ is the numeric ratio between $\gamma$ (in degrees) and $L_2$ (in inches);

$Q_2$ is the numeric ratio between $\beta$(in degrees) and R (in inches);

$Q_3$ is the numeric ratio between $L_1$ and R; and, $Q_4$ is the numeric ratio between $L_1$ and $L_2$; and wherein:

$Q_1$ is between 1 and 60; $Q_2$ is between 35 and 300; $Q_3$ is between 0.5 and 2.5; and $Q_4$ is between 1.35 and 3.25.

31. The container of claim 30 wherein $Q_1$ is 12; $Q_2$ is 85; $Q_3$ is 0.965; and $Q_4$ is 1.93.

32. The container of claim 1 wherein said bottom-closing portion includes:

a second frustoconical portion directly attached at one end thereof to the other end of said second semi-torroidal portion;

a third semi-torroidal portion directly attached at one end thereof to the other end of said second frustoconical portion;

a third frustoconical portion directly attached at a larger diameter end thereof to the other end of said third semi-torroidal portion; and a flat central portion directly attached to and closing the smaller diameter end of said third frustoconical portion.

33. The container of claim 32 wherein:

$L_1$ is the axial distance between the junction of said first frustoconical portion with said side wall and the junction of said first semi-torroidal portion with said second semi-torroidal portion;

$L_2$ is the axial distance between the junctions of said first frustoconical portion with said side wall and said first semi-torroidal portion, respectively;

R is the radius of said first semi-torroidal portion;

$\gamma$ is the angle between said first frustoconical portion and said side wall;

$\beta$ is the angle between the axis of said cylindrical side wall and a cord extending between the junctions of said first semi-torroidal portion with said first frustoconical portion and said second semi-torroidal portion, respectively;

$Q_1$ is the numeric ratio between $\gamma$(in degrees) and $L_2$ (in inches);

$Q_2$ is the numeric ratio between $\beta$(in degrees) and R (in inches);

$Q_3$ is the numeric ratio between $L_1$ and R; and, $Q_4$ is the numeric ratio between $L_1$ and $L_2$; and wherein:

$Q_1$ is between 1 and 60; $Q_2$ is between 35 and 300; $Q_3$ is between 0.5 and 2.5 and $Q_4$ is between 1.35 and 3.25.

34. A container having a side wall and a bottom wall and comprising:

a coined semi-torroidal portion;

a frustoconical portion having one end thereof directly attached to said side wall;

a semi-torroidal portion having one end thereof directly attached to said frustoconical portion and having the other end thereof directly attached to said coined semi-torroidal portion; and, a central bottom-closing portion directly attached to the other end of said coined semi-torroidal portion.

35. The container of claim 34 wherein said bottom-closing portion is domed inwardly when said container is unpressurized, but domes outwardly when said container is pressurized.

36. The container of claim 34 wherein said bottom-closing portion domes inwardly between 0.005 inch and 0.050 inch.

37. The container of claim 34 wherein the ratio of the diameter of said side wall of said container to the distance which said bottom-closing portion domes inwardly when said container is unpressurized is between 40 and 500.

38. The container of claim 34 wherein the radius of said semi-torroidal portion is between 0.200 inch and 0.700 inch.

39. The container of claim 32 wherein said third semi-torroidal portion is coined.

40. The container of claim 34 wherein said semi-torroidal portion is outwardly convex from a cord extending between said frustoconical portion and said coined semi-torroidal portion.

41. The container of claim 34 wherein said bottom-closing portion includes:

a second frustoconical portion directly attached at one end thereof to the other end of said second semi-torroidal portion;

a third semi-torroidal portion directly attached at one end thereof to the other end of said second frustoconical portion;

a third frustoconical portion directly attached at a larger diameter end thereof to the other end of said third semi-torroidal portion; and a flat central portion directly attached to and closing the smaller diameter end of said third frustoconical portion.

42. The container of claim 41 wherein said third semi-torroidal portion is coined.

43. A container having a cylindrical side wall and a bottom wall closing one end thereof and comprising:

a frustoconical portion having one end thereof directly attached to said side wall;

a first semi-torroidal portion having one end thereof directly attached to the other end of said frustoconical portion;

a second semi-torroidal portion having one end thereof directly attached to the other end of said first semi-torroidal portion; and a central bottom-closing portion directly attached to the other end of said second semi-torroidal portion, and wherein said bottom-closing portion includes:

a second frustoconical portion directly attached at one end thereof to the other end of said second semi-torroidal portion;

a third semi-torroidal portion directly attached at one end thereof to the other end of said second frustoconical portion;

a third frustoconical portion directly attached at a larger diameter end thereof to the other end of said third semi-torroidal portion; and a flat central portion directly attached to and closing the smaller diameter end of said third frustoconical portion.

44. The container of claim 43 wherein:

$L_1$ is the axial distance between the junction of said first frustoconical portion with said side wall and the junction of said first semi-torroidal portion with said second semi-torroidal portion;

$L_2$ is the axial distance between the junctions of said first frustoconical portion with said side wall and said first semi-torroidal portion, respectively;

R is the radius of said first semi-torroidal portion;

$\gamma$ is the angle between said first frustoconical portion and said side wall;

$\beta$ is the angle between the axis of said cylindrical side wall and a cord extending between the junctions of said first semi-torroidal portion with said first frustoconical portion and said second semi-torroidal portion, respecticely;

$Q_1$ is the numeric ratio between $\gamma$(in degrees) and $L_2$ (in inches);

$Q_2$ is the numeric ratio between $\beta$(in degrees) and R (in inches);

$Q_3$ is the numeric ratio between $L_1$ and R; and $Q_4$ is the numeric ratio between $L_1$ and $L_2$and wherein:

$Q_1$ is between 1 and 60; $Q_2$ is between 35 and 300; $Q_3$ is between 0.5 and 2.5; and $Q_4$ is between 1.35 and 3.25.

45. The container of claim 43 wherein said third semi-torroidal portion is coined.

46. The container of claim 1 wherein said bottom-closing portion is coined.

47. The container of claim 1 wherein said semi-torroidal portion is outwardly convex from a cord extending between said frustoconical portion and said coined semi-torroidal portion.

* * * * *